US009914005B2

(12) United States Patent
Zadman-Zeman

(10) Patent No.: US 9,914,005 B2
(45) Date of Patent: Mar. 13, 2018

(54) APPARATUSES AND METHODS FOR EXERCISE USING CIRCULAR BANDS

(75) Inventor: Ari M. Schuhmann Zadman-Zeman, Durham, NC (US)

(73) Assignee: Rubberbanditz LLC, Durham, NC (US)

( * ) Notice: Subject to any disclaimer, the term of this patent is extended or adjusted under 35 U.S.C. 154(b) by 854 days.

(21) Appl. No.: 12/914,481

(22) Filed: Oct. 28, 2010

(65) Prior Publication Data

US 2012/0108403 A1 May 3, 2012

(51) Int. Cl.
*A63B 21/02* (2006.01)
*A63B 21/055* (2006.01)
*A63B 21/00* (2006.01)

(52) U.S. Cl.
CPC ..... *A63B 21/0555* (2013.01); *A63B 21/0004* (2013.01); *A63B 21/00185* (2013.01); *A63B 21/4035* (2015.10)

(58) Field of Classification Search
CPC ... A63B 21/02; A63B 21/055; A63B 21/0552; A63B 21/0555
USPC ..... 482/121, 122, 124, 126; 473/207, 208, 473/212, 213, 216
See application file for complete search history.

(56) References Cited

U.S. PATENT DOCUMENTS 1,663,641 A * 3/1928 Smallwood ..... A63B 21/0004 482/124
1,706,654 A * 3/1929 Christesen ..... 482/125
1,998,226 A * 4/1935 Draheim ..... A63B 21/0552 482/121
4,090,706 A * 5/1978 Reda ..... 482/122
4,245,840 A * 1/1981 Van Housen ..... A63B 21/0004 24/115 H
4,565,367 A * 1/1986 Kaiser ..... 482/131
4,852,874 A * 8/1989 Sleichter ..... A63B 21/0004 482/122
4,909,505 A * 3/1990 Tee ..... 482/129
5,149,099 A * 9/1992 Radakovich ..... 473/208
5,318,494 A * 6/1994 Santighian ..... A63B 21/0004 482/121
5,570,472 A 11/1996 Dicker
5,711,747 A 1/1998 Steinback
5,727,254 A 3/1998 Dicker
5,857,945 A * 1/1999 Papp ..... A63B 21/0004 482/121

(Continued)

OTHER PUBLICATIONS

Bodylastics Resistance Bands, http://www.bodylasticsresistancebands.com, printed Feb. 14, 2012.

(Continued)

*Primary Examiner* — Joshua Lee
(74) *Attorney, Agent, or Firm* — Kilpatrick Townsend & Stockton LLP

(57) ABSTRACT

An exercise apparatus is provided, the exercise apparatus including a circular elastic band and a handle attached to the band. Also provided is an exercise apparatus comprising a circular elastic band and an anchor device attached to the band. Also provided is a method of exercising the human body with a circular elastic band is provided, the method including exerting a force in one or more planes to stretch the elastic band and releasing the force exerted in one or more planes to allow the elastic band to retract.

11 Claims, 18 Drawing Sheets

(56) References Cited

U.S. PATENT DOCUMENTS

| | | | | |
|---|---|---|---|---|
| 5,885,175 | A * | 3/1999 | Marquez | 473/464 |
| 5,945,060 | A | 8/1999 | Williams | |
| 6,561,930 | B2 * | 5/2003 | Mabry | 473/457 |
| 6,605,022 | B2 | 8/2003 | Webber | |
| 7,278,960 | B1 | 10/2007 | McGibbons | |
| 7,651,451 | B2 * | 1/2010 | Jensen | A63B 21/02 482/122 |
| D616,509 | S * | 5/2010 | Perez et al. | D21/692 |
| 2003/0181301 | A1 * | 9/2003 | Walsh | A63B 21/0004 482/148 |
| 2004/0067827 | A1 | 4/2004 | Tustin | |
| 2004/0204302 | A1 * | 10/2004 | Flynn | 482/124 |
| 2006/0183609 | A1 | 8/2006 | Flynn | |
| 2007/0232468 | A1 * | 10/2007 | Levy | A63B 21/0004 482/121 |
| 2008/0009398 | A1 * | 1/2008 | Grisdale | 482/124 |
| 2008/0096737 | A1 * | 4/2008 | Ayoub | 482/107 |
| 2008/0220953 | A1 | 9/2008 | Bowser | |
| 2009/0275449 | A1 * | 11/2009 | Terry | 482/139 |
| 2010/0041527 | A1 | 2/2010 | Miller | |

OTHER PUBLICATIONS

Aylio Resistance Bands, http://www.aylio.com, printed Feb. 14. 2012.

Official Tower 200, http://www.officialtower200.com, printed Feb. 14, 2012.

Ripcords, http://www.ripcords.com/ripcords-packages.html, printed Feb. 14, 2012.

Jump Stretch, http://www.jumpstretch.com/osc/catalog/index.php?cPath=21, printed Feb. 14, 2012.

Quest, http://quest-nutrition.com/store/scripts/prodListasp?idCategory=35, printed Feb. 14, 2012.

Brute Bands, http://www.bruteathletics.com/brute-products, printed Feb. 14, 2012.

EliteFTS, http://www.flexcart.com/members/elitefts/defaultasp?SearchPhrase=bands&x=0&y=0&m=SR, printed Feb. 14, 2012.

IronWoody, http://www.ironwoodyfitness.com/equipment/iron-woody-bands.html, printed Feb. 14, 2012.

RBT, https://rbt.infusionsoft.com/cart/store.jsp, printed Feb. 14, 2012.

* cited by examiner

APPARATUSES AND METHODS FOR EXERCISE USING CIRCULAR BANDS

FIELD OF THE INVENTION

The present invention relates generally to exercise devices and methods. More particularly, the invention relates to exercise devices and methods incorporating one or more circular elastic bands.

BACKGROUND

Traditional resistance exercise techniques typically involve the use of weight machines or free weights, the latter often used in combination with a variety of bars and benches. Traditional exercise techniques often involve isolating and fatiguing one muscle or muscle group at a time. Traditional resistance training equipment and techniques suffer from a number of disadvantages.

A short walk through a local gym or fitness club reveals racks of free weights and numerous space-hogging benches and weight machines, many designed to exercise a single muscle group. For most people, the sheer bulk of the equipment forecloses any possibility of a comprehensive home fitness center comprised of traditional equipment. In addition, a comprehensive set of traditional resistance fitness equipment generally costs thousands of dollars. Due to these space and cost restraints, individuals are faced with the decision of purchasing a gym membership and commuting to the gym or buying a space-saving less comprehensive and less bulky "home gym".

Furthermore, individuals seeking to maintain a regular regimen of resistance exercise face additional challenges when traveling for business or pleasure. During travel, one may often find that fitness centers in hotels have little to no resistance equipment, that the closest franchise of the gym to which they belong is not convenient, or that the campground or similar location is completely lacking any sort of fitness equipment at all. Traditional resistance equipment, and even more compact "home gyms" are too bulky to conveniently take on trips.

In addition to cost and portability issues, traditional free weights can cause undesired negative effects. They are bound by the law of gravity and therefore only supply a downward force. In addition to inherent risks related to accidentally dropping weights, over time downward force takes a toll on a person's joints. For similar reasons, safely working with free weights sometimes requires a "spotter".

Traditional exercise using both free weights and traditional weight machines generally operates to isolate and fatigue muscles through movement in a single plane in order to increase strength and muscle mass. However, these techniques can lead to stiffness and limited range of motion. A growing trend is towards functional training, which enhances normal body movements instead of isolating one muscle at a time.

For the foregoing reasons, there is a need for affordable, compact and portable resistance training equipment and techniques that provide the ability to perform a comprehensive workout regimen at home or while travelling, thereby eliminating the need for a traditional gym and the inherent problems with using a traditional gym such as inaccessibility, wasted travel time, and expense. Furthermore, there is a need for resistance training equipment that facilitates multi-planar and functional training exercises in addition to traditional isolation-based exercises.

SUMMARY

In one embodiment, an exercise apparatus is provided, the exercise apparatus including a circular elastic band and a handle attached to the band.

Also provided is an apparatus wherein the handle comprises a rigid or semi-rigid internal support structure.

Further provided is an apparatus wherein the handle is attached to the band via a clip. In one embodiment, the clip is a carabiner. In another embodiment, the carabiner is a triangular carabiner. Also, the attachment may include a padded grip.

In another embodiment, an exercise apparatus is provided, the exercise apparatus comprising a circular elastic band and an anchor device attached to the band.

Also provided is an apparatus further including a clip attached to the band. In one embodiment, the clip is a carabiner. In another embodiment, the carabiner is a triangular carabiner.

Also provided is an apparatus further including a bat attached to the band. Also provided is an apparatus further including a golf club attached to the band. Further provided is an apparatus further including a handle attached to the band. Further provided is an apparatus further including a bar attached to the band. Also provided is an apparatus further including a gripping device attached to the band.

In one embodiment, a method of exercising the human body with a circular elastic band is provided, the method including exerting a force concurrently in one or more planes to stretch the elastic band and releasing the force exerted concurrently in the one or more planes to allow the elastic band to retract.

Also provided is a method wherein concurrently exerting a force in one or more planes to stretch the elastic band comprises exerting force on an attachment attached to the elastic band. Further provided is a method, wherein the attachment is a clip. Also provided is a method wherein the clip is a carabiner. In another embodiment, the carabiner is a triangular carabiner.

Also provided is a method wherein concurrently exerting a force in one or more planes includes performing a squat exercise. Also provided is a method wherein concurrently exerting a force in two or more planes includes performing a core twist exercise. Also provided is a method wherein concurrently exerting a force in two or more planes includes performing a starfish exercise.

DETAILED DESCRIPTION

Figure 1:
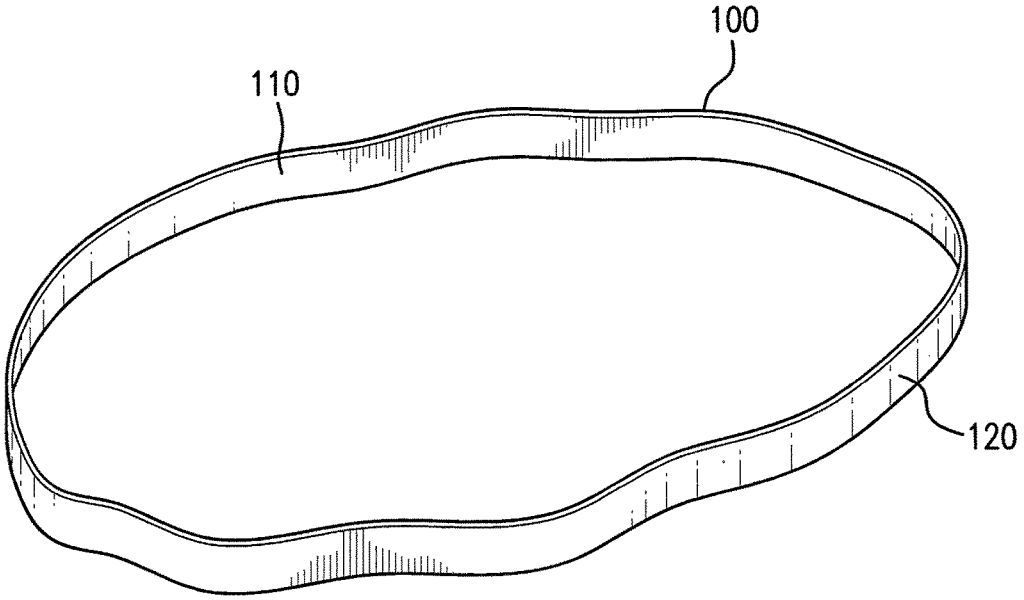
FIG. 1 is an example of an elastic band according to one embodiment of the invention.

FIG. 1 is an example of an elastic band according to one embodiment of the invention. In one embodiment, an elastic band 100 is provided. The elastic band 100 may be circular in shape. In other embodiments, the elastic band 100 may be straight, tube-shaped, or any other known shape or configuration.

In various embodiments, the band 100 may be made of rubber, latex, or any other known elastic material. In one embodiment, the band 100 is a continuous rubber strip. The band 100 may be made of multiple layers. In various embodiments, the band 100 is between ten and twenty layers thick. A thicker band typically provides more resistance than a thinner band of the same diameter and material.

In some embodiments, the band 100 is between 35 and 45 inches in diameter. In other embodiments, the band 100 can be any other diameter, such as, for example, 20 inches, 60 inches, or 80 inches.

In some embodiments, the band 100 is flat. For example, in FIG. 1, the inner surface 110 and outer surface 120 are both flat. An advantage of a flat surface as contrasted with a round surface is that a user can wrap the band 100 around an object, such as a pole, post, or tree, and it grips the surface more effectively than a band with a round surface.

Another advantage of a flat surface is that the band may be doubled up in order to increase resistance. One way to do this is to use two bands. Another is to effectively fold the band 100 in half, thereby decreasing its effective diameter by 50% and increasing its resistance. Correspondingly, the band 100 can be folded in half or reduced in length by partitioning off a portion of the band to reduce the overall exposed workout area of the band, thereby raising the net resistance. In addition, the band 100 may be manufactured as a continuous elastic strip, allowing the band to slowly peel over time rather than snap, thereby providing exceptional durability and safety.

Figure 2:
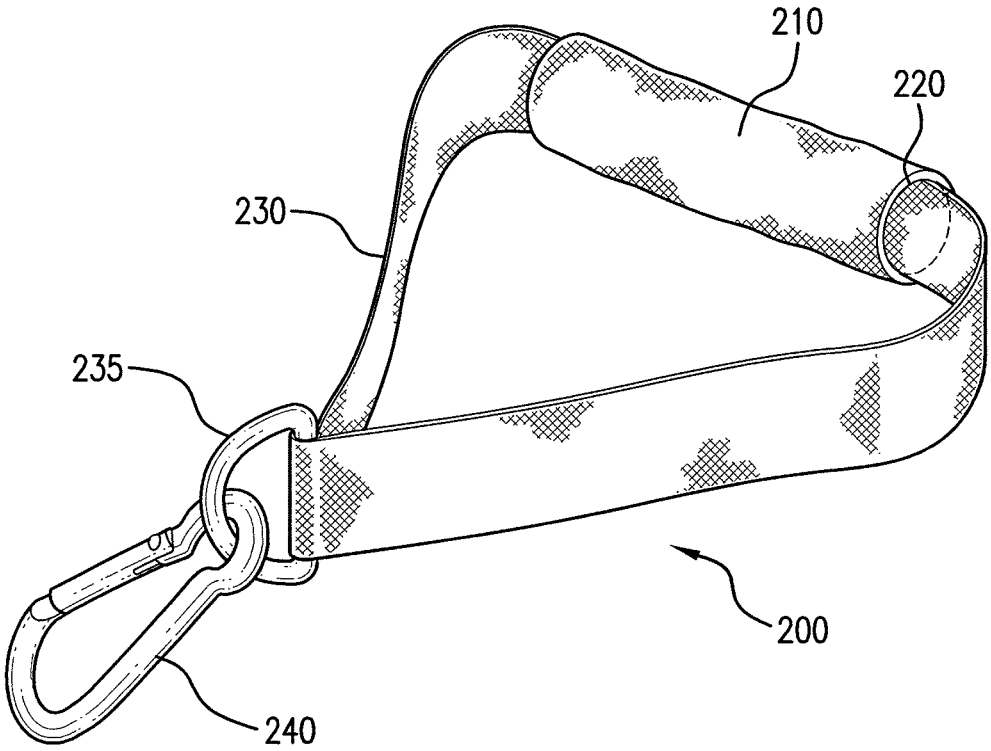
FIG. 2 is an example of a handle according to one embodiment of the invention.

FIG. 2 is an example of a handle according to one embodiment of the invention. In various embodiments, a handle 200 may be attached to the band 100. In one embodiment the handle comprises an outer surface 210 and an inner surface 220. The outer surface 210 may be made of foam, plastic, leather, canvas, or any other material. The inner surface 220 may be made of foam or any other padded material. It may also comprise a rigid or semi-rigid support structure. In some embodiments, the inner surface 220 and outer surface 210 are made of the same material.

In some embodiments, the outer surface 210 is wrapped around the inner surface 220. The outer surface 210 may be attached to the inner surface 220 by any known means, such as Velcro or glue. In one embodiment, the outer surface 210 is a canvas material tightly wrapped around the inner surface 220 and is attached to itself via Velcro.

In some embodiments, the inner surface 220 is connected to a strap 230. The inner surface 220 may be wrapped around the strap 230 or attached to the strap 230 in any other known manner. In one embodiment, the inner surface 220 is a tube and the strap 230 passes through the inside of the tube. The strap 230 may be made of any known natural or synthetic material. For example, the strap 230 may be made of canvas, polypropylene, polyester, or woven nylon.

In various embodiments, the strap 230 is a closed loop. The loop can be of a variety of diameters, depending on factors such as the intended purpose of the handle 200 or the intended user of the handle 200 (e.g., children, bodybuilders, athletes, senior citizens). Some examples of appropriate diameters include four inches, eight inches, and twelve inches. The strap may have a thickness of approximately 1/32 inch to 1/8 inch, or any appropriate thickness. The strap may have a width of any appropriate size. For example, the width may be narrower, such as 1/8 to 3/4 inch. Or it may be wider, such as one inch to five inches.

In some embodiments, a loop 235 is attached to the strap 230. The loop 235 may comprise any appropriate material, such as metal, hard plastic, or woven material. In some embodiments, the loop 235 is comprised of the same material as the strap 230. In some embodiments, the loop 235 is positioned away from the handle grip. The loop 235 may be used to attach the handle to other objects, such as a band 100 or a clip 240.

In some embodiments, a clip 240 is provided. The clip 240 may comprise any appropriate clip, such as a carabiner. In some embodiments, the clip 240 is attached to the strap 230. Further, the clip 240 may be attached to the loop 235. A benefit of using a clip 240 is that it provides a simple way to attach the handle 200 to other objects, such as a band 100.

Figure 3:
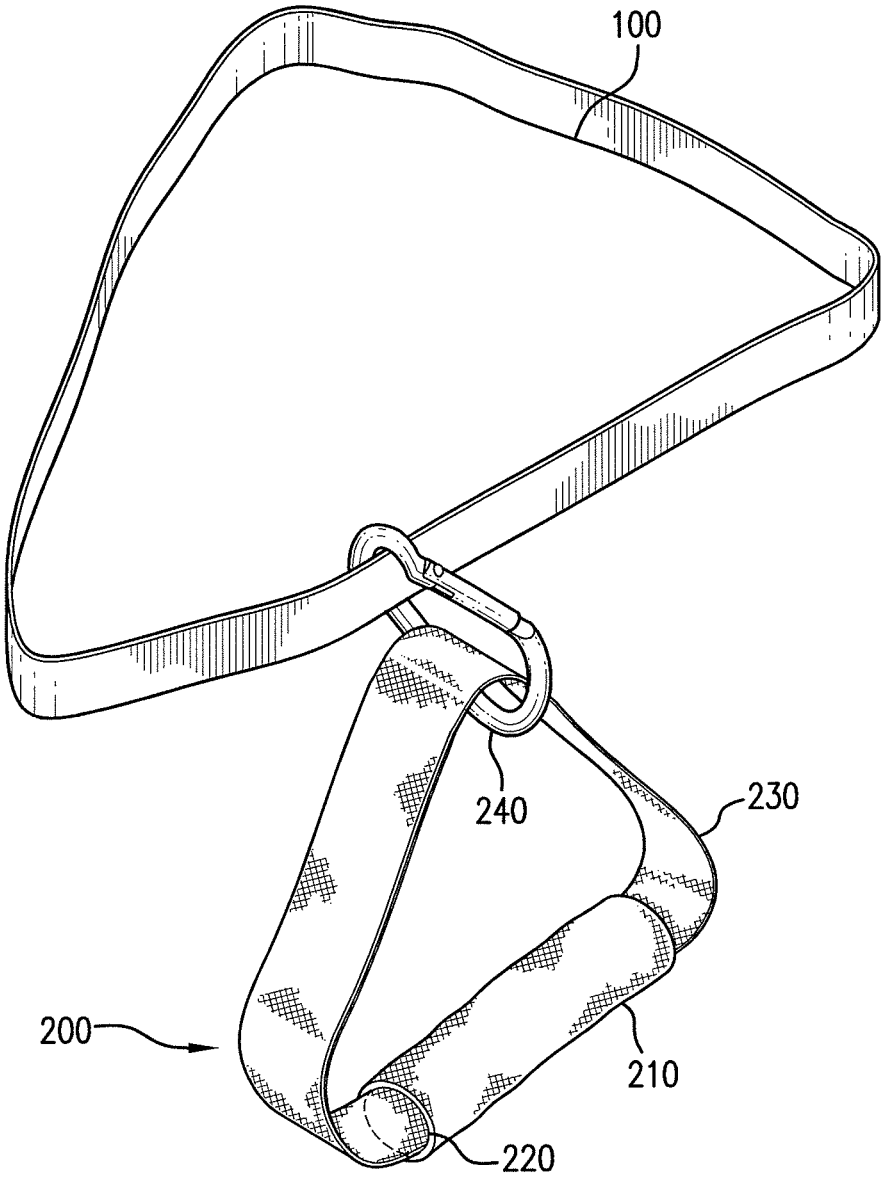
FIG. 3 is an example of a handle attached to an elastic band according to one embodiment of the invention.

FIG. 3 is an example of a handle attached to an elastic band according to one embodiment of the invention. In various embodiments, the handle 200 is attached to the band 100. There are a variety of advantages to attaching the handle 200 to the band 100. For example, many users find it more comfortable to perform exercises such as "curls," "presses," and the like using one or more handles 200 rather than directly touching the band 100 with the hand. This can be particularly true when performing higher numbers of repetitions as well as when exercising with stronger resistance. Additionally, as mentioned herein, at times it is advantageous to "double up" bands for various exercises. In such circumstances it may be advantageous to use a handle 200 to harness the doubled-up bands. For example, it may be simpler and/or more comfortable to grasp a single handle 200 rather than multiple bands 100.

The handle 200 may be attached to the band 100 in a variety of ways. For example, a clip 240 may be used to connect the handle 200 to the band 100. In some embodiments, the clip 240 comprises a carabiner. The clip 240 may be made of any suitable material, such as aluminum, steel, or high-strength plastic. An advantage to using a carabiner is that it easily attaches to a ring or loop. Thus, it can easily attach to the handle 200 and the band 100. Examples of carabiners are described in more detail in connection with FIG. 4. Carabiners may comprise a variety of devices capable of connecting an external accessory to the band 100.

Persons of skill in the art will recognize that there are other ways to attach the handle 200 to the band 100. For example, the strap 230 could wrap around one or more bands 100. This could be accomplished by encircling the band 100 with the strap and sewing one end of the strap 230 to the other end of the strap 230.

Figure 4:
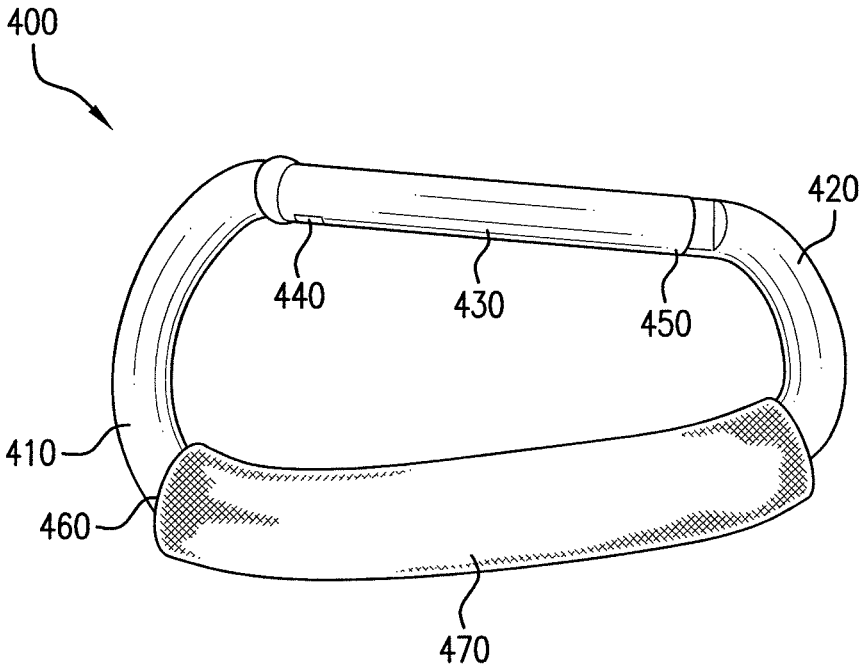
FIG. 4 is an example of a carabiner according to one embodiment of the invention.

FIG. 4 is an example of a carabiner according to one embodiment of the invention. In one embodiment, a carabiner 400 is provided. The carabiner 400 may have a top 410 and a bottom 420. The carabiner 400 may also have a gate 430 with a free end 450 and a pivot end 440. The carabiner also may have a side member 460. In some embodiments, the carabiner 400 also includes a grip 470.

The carabiner can be of any appropriate size. For example, it could be one to two inches from top 410 to bottom 420. Alternatively, it could be larger, for example, four to eight inches from top 410 to bottom 420. It could be half an inch to one inch from gate 430 to side member 460. It could also be two inches to four inches from gate 430 to side member 460. One of skill in the art will recognize that other acceptable dimensions would also be compatible with embodiments of the invention.

The gate 430 may be used to allow objects to pass into the carabiner 400. For example, the gate 430 may be used to allow a band 100 to pass through. Also, the gate 430 may be used to allow a handle 200 or a strap 230 to pass through. Such an example can be seen in FIG. 3.

The gate 430 opens by means of the pivot end 440 pivoting and thus disassociating the free end 450 from the top 410. In some embodiments, the pivot end 454 is spring loaded so that when the gate 430 is released, the free end 450 returns to the top 410.

One of skill in the art will recognize that other types and shapes of carabiners may be used in embodiments of the invention, and that the carabiner depicted and described herein is merely exemplary. For example, oval-shaped carabiners and triangular carabiners may be used. Also, wire, locking, and/or non-locking carabiners may be used.

In some embodiments, the carabiner 400 also includes a grip 470. In some embodiments, it may be advisable to include a grip 470 on larger carabiners, such as those that fit a human hand. One benefit of such embodiments is that it allows the user to grip the carabiner 400 rather than the band 100 itself. Also it can provide similar functionality to a handle 200. Thus, the carabiner 400 with a grip 470 could eliminate the need for a separate handle 200 for some exercises, thus reducing the number of components needed. This could also reduce the amount of distance between the user's body and the band 100, thus increasing resistance.

Figure 5:
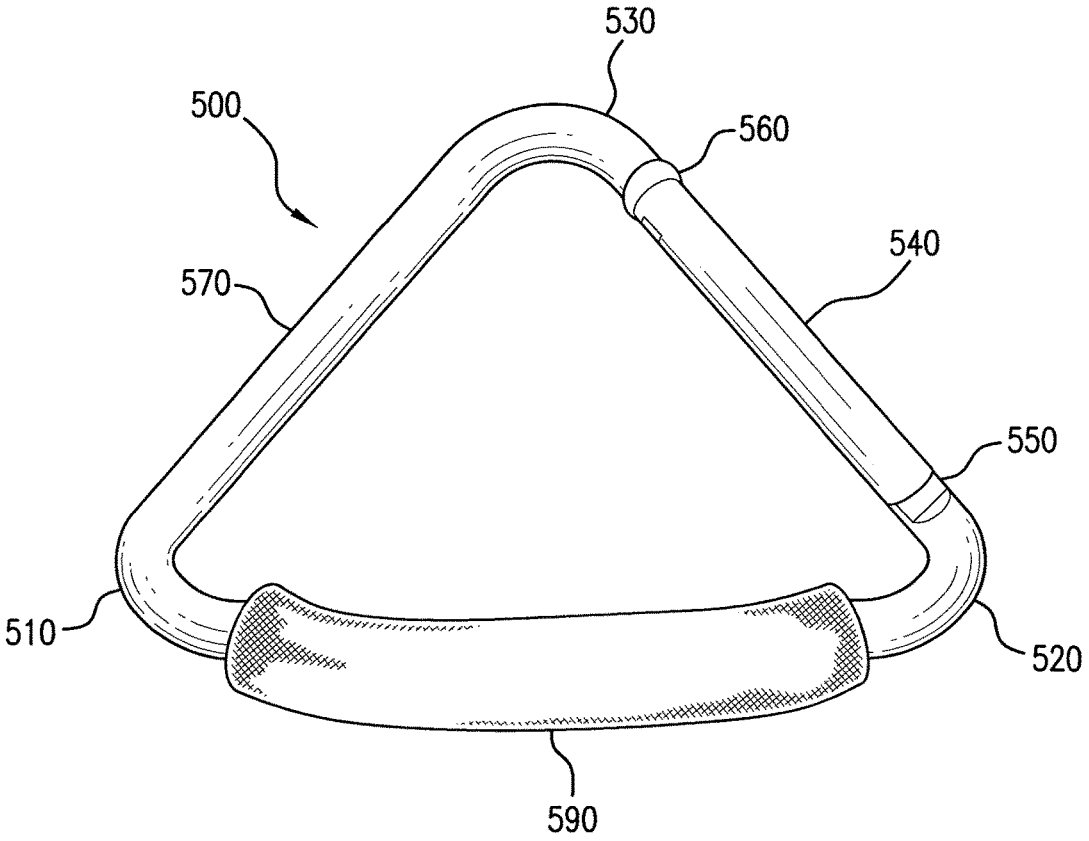
FIG. 5 is an example of a triangular carabiner according to one embodiment of the invention.

FIG. 5 is an example of a triangular carabiner according to one embodiment of the invention. In some embodiments, a triangular carabiner 500 is disclosed. The triangular carabiner 500 includes a first corner 510, a second corner 520, and a third corner 530. The triangular carabiner 500 also includes a gate 540 with a pivot end 560 and a free end 550. The triangular carabiner 500 further includes a first side 570 and a second side 580. In some embodiments, the triangular carabiner 500 also includes a grip 590.

The carabiner can be of any appropriate size. For example, it could be one to two inches from the first corner 510 to the second corner 520 and third corner 530. Alternatively, it could be larger, for example, four to eight inches from the first corner 510 to the second corner 520 and third corner 530. It could be one to two inches from the gate to the first corner 510. It could also be two inches to six inches from the gate to the first corner 510. One of skill in the art will recognize that other acceptable dimensions would also be compatible with embodiments of the invention.

The gate 540 may be used to allow objects to pass into the triangular carabiner 500. For example, the gate 540 may be used to allow a band 100 to pass through. Also, the gate 540 may be used to allow a handle 200 or a strap 230 to pass through. Such an example can be seen in FIG. 3.

The gate 540 opens by means of the pivot end 560 pivoting and thus disassociating the free end 550 from the portion of the triangular carabiner 500 near the third corner 530. In some embodiments, the pivot end 560 is spring loaded so that when the gate 540 is released, the free end 550 returns to the portion of the triangular carabiner 500 near the third corner 530.

One of skill in the art will recognize that other types of carabiners may be used in embodiments of the invention, and that the carabiner depicted and described herein is merely exemplary. For example, wire, locking, and/or non-locking carabiners may be used.

In some embodiments, the carabiner 500 also includes a grip 590. In some embodiments, it may be advisable to include a grip 590 on larger carabiners, such as those that fit a human hand. One benefit of such embodiments is that it allows the user to grip the carabiner 500 rather than the band 100 itself. Also it can provide similar functionality to a handle 200. Thus, the carabiner 500 with a grip 590 could eliminate the need for a separate handle 200 for some exercises, thus reducing the number of components needed. This could also reduce the amount of distance between the user's body and the band 100, thus increasing resistance.

Figure 6:
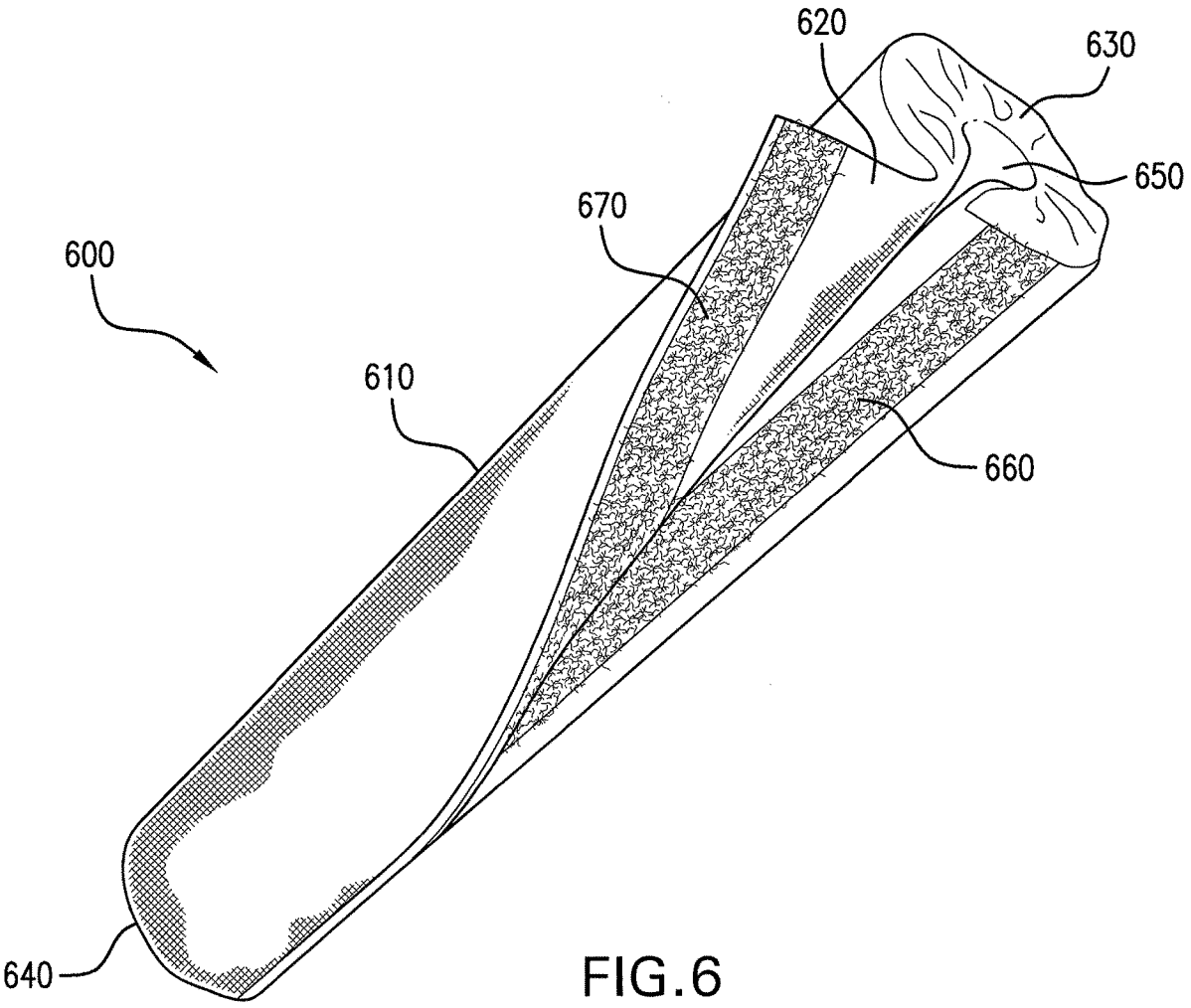
FIG. 6 is an example of a grip according to one embodiment of the invention.

FIG. 6 is an example of a grip according to one embodiment of the invention. In some embodiments, a grip 600 is provided. The grip 600 may include an outer edge 610 and an inner edge 620. Further, the grip 600 may include a top 630 and a bottom 640. The grip may also include a channel 650. Also, the grip may include a fastener, such as Velcro strips 660 and 670. The channel 650 may also remain open so that the band can be easily inserted and released. In such embodiments, the grip would have a rigid structure such as PVC but be somewhat supple as well so that when grasping the grip, the channel would close in order to prevent the band from slipping out.

In some embodiments, it is advisable to use a grip 600. For example, a user may desire to exercise with a band 100 without the use of a handle 200. A benefit of exercising without using a handle 200 is that there is greater resistance. Also, some users have more control when touching the band 100 without a handle 200.

However, some users find that performing some exercises directly touching the band 100 is not comfortable, for example, on their hands. Thus, there is a need for a way to allow a user's hands to be close to the band 100 and also to provide some padding and/or protection to the user's hands. One way to meet these needs is to use a grip 600. In some embodiments, a user can insert a portion of the band 100 into the channel 650. In such an instance, the inner edge 620 of the grip 600 may rest against the band 100.

In some embodiments, the grip 600 includes a fastener. A benefit of a fastener is that it helps to prevent the grip 600 from sliding or falling off of the band 100. In one embodiment, the fastener comprises Velcro strips 660 and 670.

As discussed herein, one benefit of using a grip 600 is to cushion and/or protect the user's hand. In some embodiments, the grip 600 contains padding between the channel 650 and the outer edge 610. This padding may be of any suitable material, such as polyethylene foam, neoprene foam, or rubber. The padding may be protected by the inner edge 620 and outer edge 610. Alternatively, the inner edge 620 and/or the outer edge 610 may comprise padding. The grip 600 can range in thickness. For example, in some embodiments, the grip 600 is between ¼ inch and one inch thick. In other embodiments, the grip is thicker than one inch.

In some embodiments, the grip 600 may comprise a rigid or semi-rigid support structure. The support structure may be contained within the outer edge 610 or may be contained within the inner edge 620.

Figure 7:
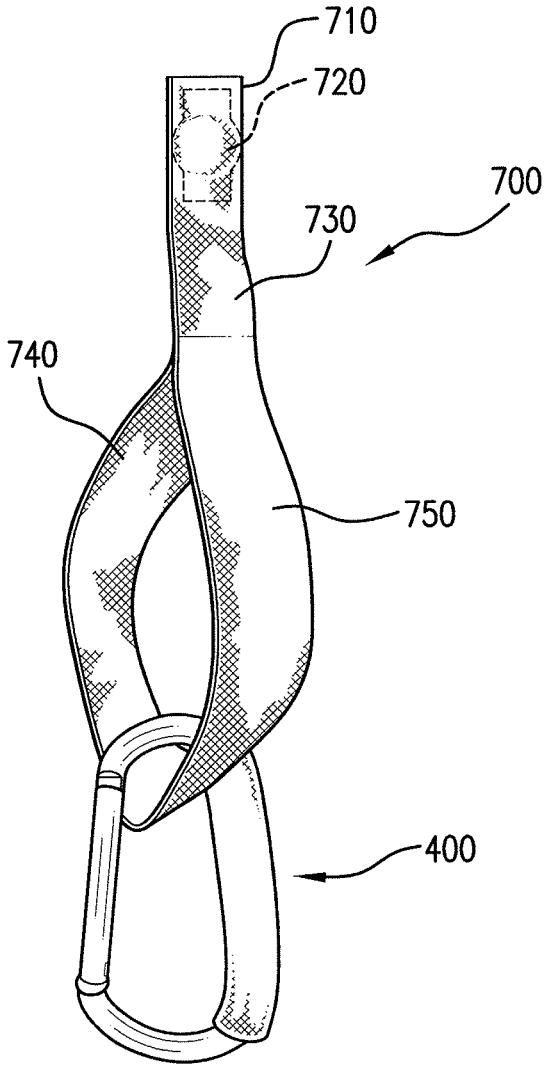
FIG. 7 is an example of an anchor device according to one embodiment of the invention.

FIG. 7 is an example of an anchor device comprising a door strap according to one embodiment of the invention. One or more anchor devices used in conjunction with one or more bands 100 may be used to perform a number of different exercises. An anchor device may be any object that is used to affix, immobilize, or attach a band 100 to an anchor point. For example, an anchor device may be an eye bolt fastened to a wall, floor, door, tree, ceiling or other anchor point. Other examples of anchor devices include Velcro loops, hooks, and gripping devices as described in relation to FIG. 8, but used as anchor device rather than attaching it to a body part. An anchor point may also be a chair, desk, or any other object to which one or more bands 100 may be anchored using an anchor device to immobilize a portion of the one or more bands 100.

In one embodiment, a door strap 700 is provided. The door strap 700 may include a top 710. In some embodiments, the top 710 is comprised of woven nylon, but can be made of any suitable material. The top 710 may include a stopper 720, such as a bead or other small, hard object. The stopper 720 may be positioned between layers of the top 710. A benefit of the stopper is that it can prevent the door strap 700 from being pulled through the gap between the door and door jam.

Additionally, the door strap 700 includes a bottom 730 including a first side 740 and a second side 750. The bottom may also be comprised of woven nylon or any other suitable material. In some embodiments, the door strap 700 is one single piece of material. In other embodiments, the door strap 700 comprises a plastic, PVC, or similar coating.

The door strap 700 may be of any appropriate size and dimensions. In some embodiments, it is advisable for the door strap 700 to be relatively small. One benefit of a small door strap 700 is that it allows for the user to have more resistance when using the door strap in connection with a band 100. In some embodiments, the door strap 700 is approximately one inch wide. According to various embodiments, this may vary as needed. Examples of other appropriate widths range from one-half inch or smaller to two inches or larger. The top 710 can be any appropriate size. For example it may be approximately one square inch. Alternatively, it could be rectangular, as well as smaller or larger as necessary. In one embodiment, the stopper 720 is positioned toward the far edge of the top 710. In other embodiments, the stopper 720 is positioned toward the middle or near edge of the top 710, such as closer to the bottom 730. The bottom may be of varying lengths. For example, it may be three to six inches. A shorter length typically results in more resistance, and a longer length typically results in less resistance.

In some embodiments, a fastener such as a carabiner 400 is attached to the bottom 730 of the door strap 700. The carabiner 400 may be used to attach the door strap 700 to a band 100 using techniques such as those discussed herein. Also, a band 100 can be attached to the door strap 700 in various other ways. For example, the door strap may be sewn such that the band 100 is permanently attached to the door strap. Also, a user may use known knot-tying techniques to attach the band 100 to the door strap.

A user can utilize the door strap 700 in a variety of ways. For example, the user can open a door, place the door strap 700 against the door jamb such that the top 710, and particularly the stopper 720, is on the other side of where the door will be after it is closed. The user may, while holding the door strap 700 in place, close the door and pull the strap toward himself or herself. The door strap 700 should stay in place because the stopper 720 is on the other side of the door and is prevented from passing though the gap between the door and the door jamb. As discussed herein, a benefit of this technique is that the user now has an anchor point from which exercises may be performed.

In order to utilize the door strap 700, the next step is to attach the band 100 to the door strap 700. As discussed herein, there are a variety of ways this may be done. For example, a carabiner 400 may be used, a knot may be tied, or the user may simply pass the band 100 through the aperture between the first side 740 and second side 750.

In order to perform exercises using the band 100 and door strap 700, the user may utilize other components, such as one or more handles 200, carabiners 400, 500, grips 600, gripping devices 800, and/or bars 900. Also, a user could utilize a bar, for example, to perform exercises that involve both arms. Further, a user could attach a gripping device to his ankles and to the band 100 in order to perform lower-body exercises. Also, the user may simply use the band 100 without such components. The user can perform a variety of exercises, such as pulldowns, curls, bent-over rows, horizontal extensions, and presses.

Figure 8:
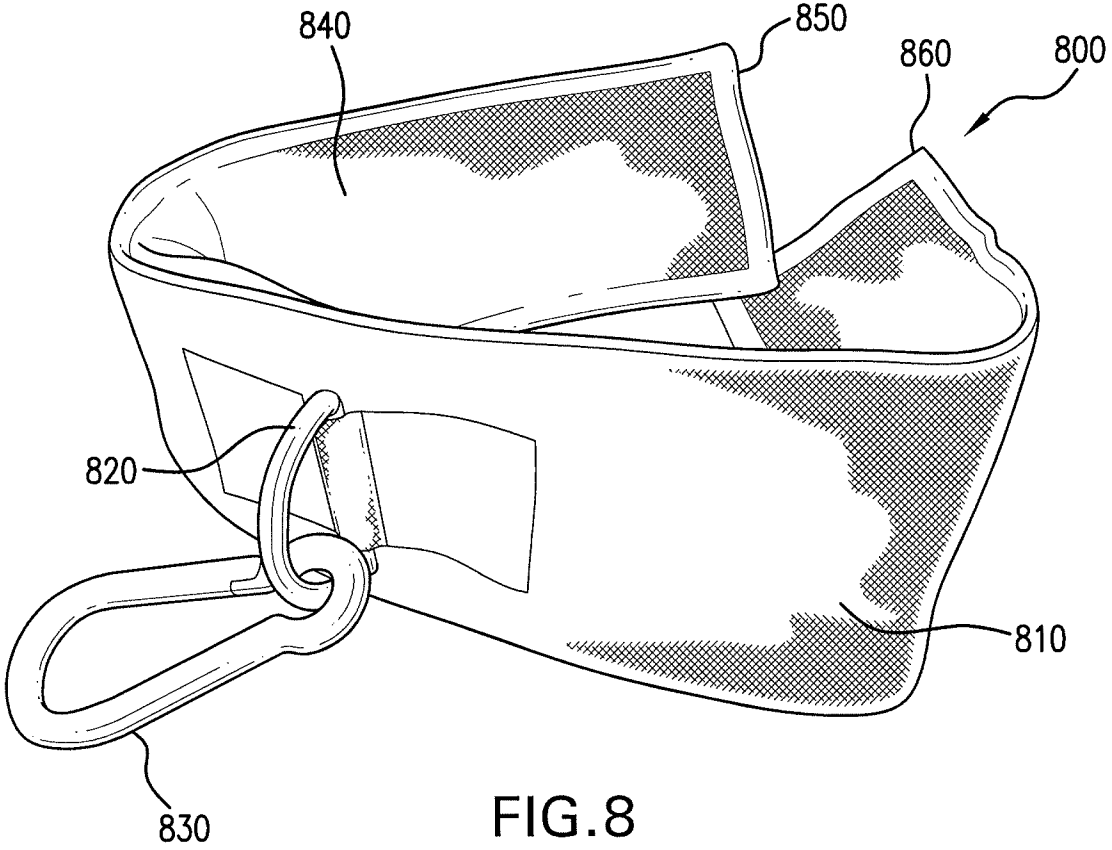
FIG. 8 is an example of a gripping device according to one embodiment of the invention.

FIG. 8 is an example of an gripping device according to one embodiment of the invention. In various embodiments, a gripping device 800 may be attached to the band 100. In one embodiment the gripping device comprises an outer surface 810 and an inner surface 840. The outer surface 810 may be made of leather, nylon, canvas, or any other suitable material. The inner surface 840 may be made of leather, nylon, canvas, fabric or any other suitable material. In some embodiments, a padding material may be positioned between the outer surface 810 and the inner surface 840. The padding material may be foam or any other material that provides padding.

Additionally, the gripping device 800 comprises a coupling mechanism for coupling together strap ends 850 and 860. The coupling mechanism may be Velcro, a snap, a button, a latch, a buckle, or any other suitable coupling mechanism. The coupling mechanism may be used to attach the gripping device to various body parts including an ankle or a wrist.

Furthermore, the gripping device 800 comprises an attachment point 820. An attachment point may be any object to which a band 100 may be affixed. For example, an attachment point may be an eyelet, ring, or any other suitable mechanism incorporated into the outer surface 810 and/or inner surface 840 of the gripping device 800. In some embodiments, a fastener such as a carabiner 830 may be used to attach band 100 to attachment point 820.

Attaching the gripping device to a body part and a band 100 allows a user to more easily perform various leg, arm, and other exercises. Alternatively, the gripping device may be used as an anchor device by affixing it to an anchor point such as a pole, tree or other fixed object. In some embodiments, the device is attached to any of a variety of separate apparatuses such as a bar 900, bat 1310, club 1410, ball or any other object for the purpose of adding resistance to a particular movement. For example, an embodiment may include placing the strap 100 on the end of a baseball bat 1310 and adding resistance to the batters swing.

Figure 9:
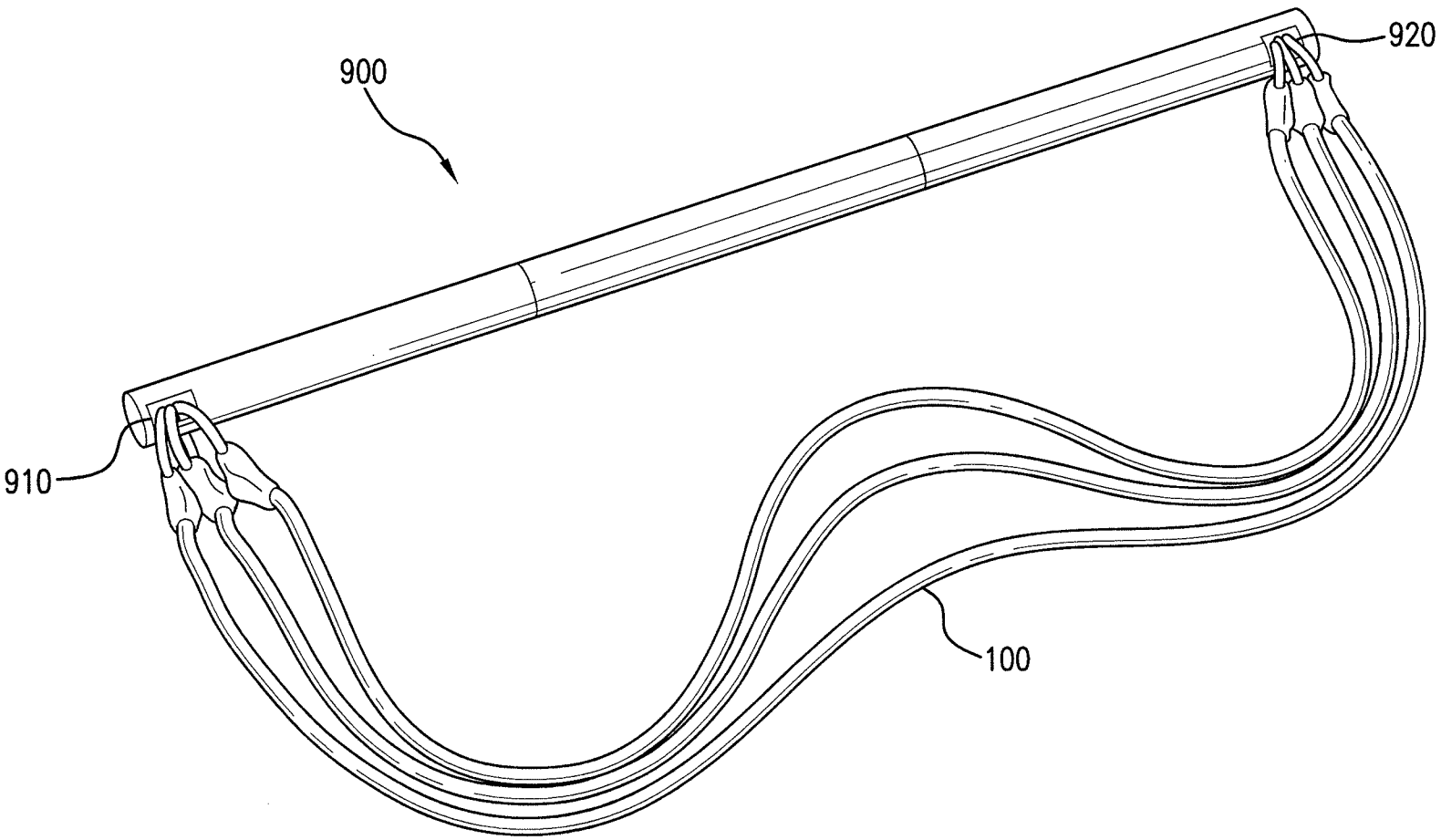
FIG. 9 is an example of a bar for use with elastic bands according to one embodiment of the invention.
Figure 10C:
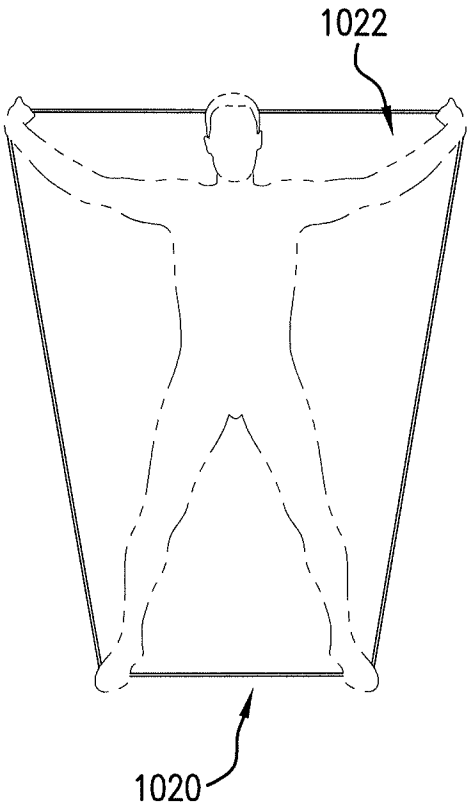
FIGS. 10A-10C include examples of performing exercises using an elastic band according to one embodiment of the invention.
Figure 10B:
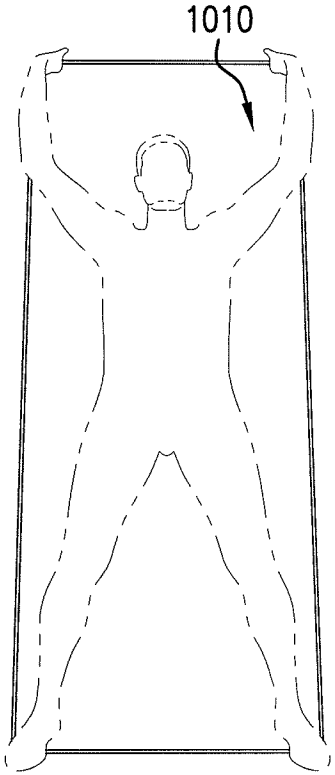
Figure 10A:
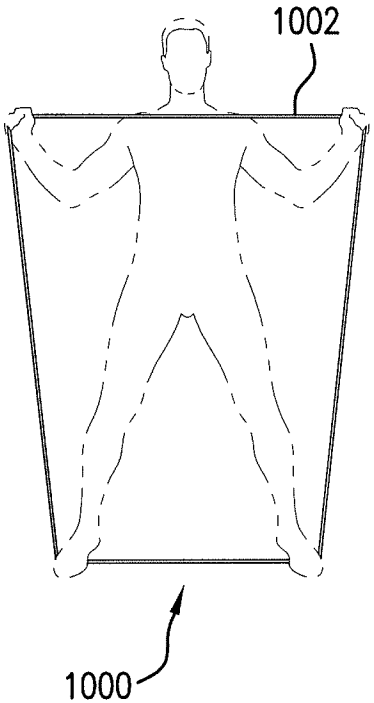
Figure 10E:
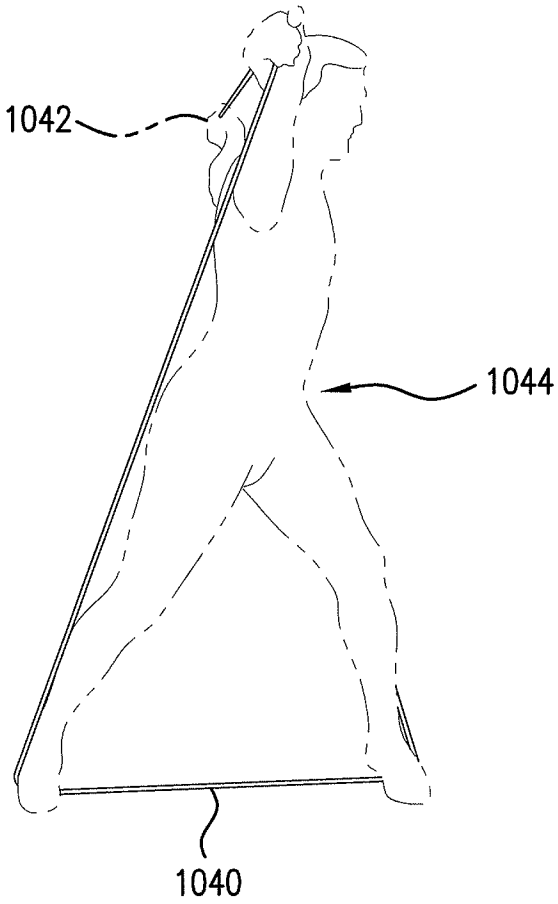
FIGS. 10D-10E include examples of performing exercises using an elastic band according to another embodiment of the invention.
Figure 10D:
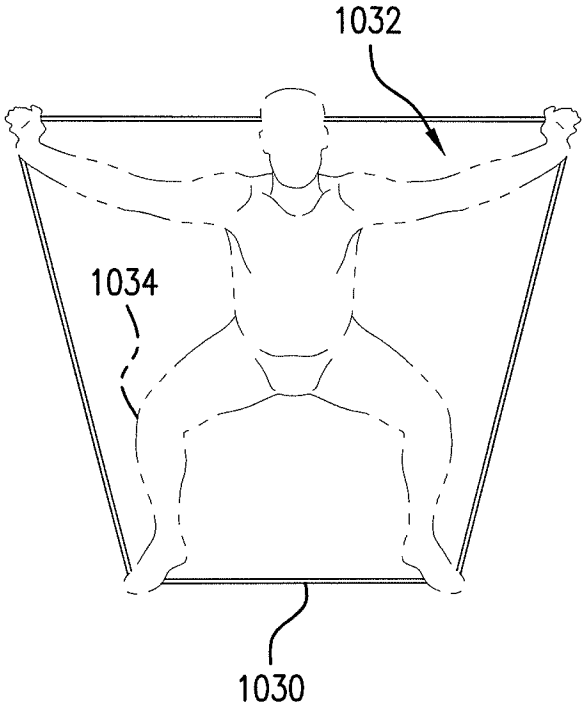
Figure 11C:
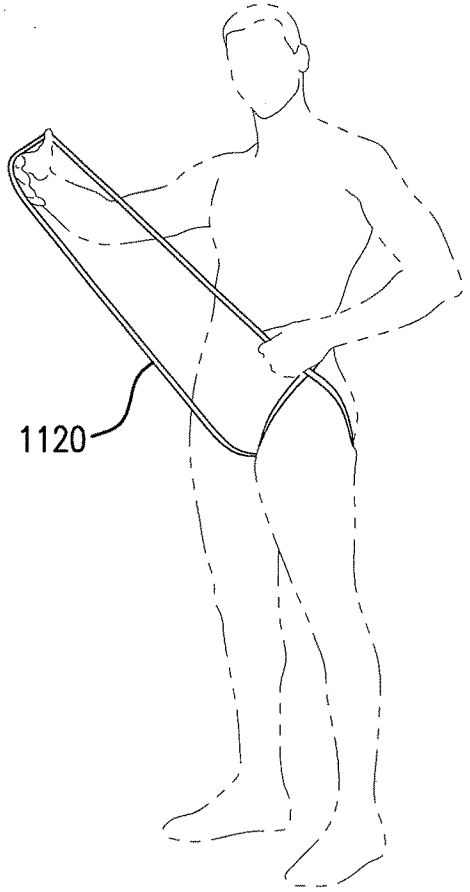
FIGS. 11A-11E are an example of performing an exercise using two elastic bands according to one embodiment of the invention.
Figure 11B:
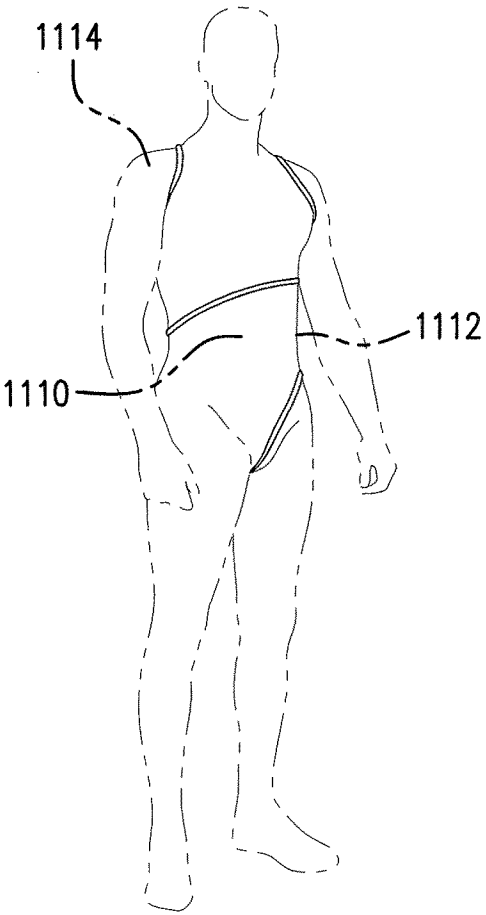
Figure 11A:
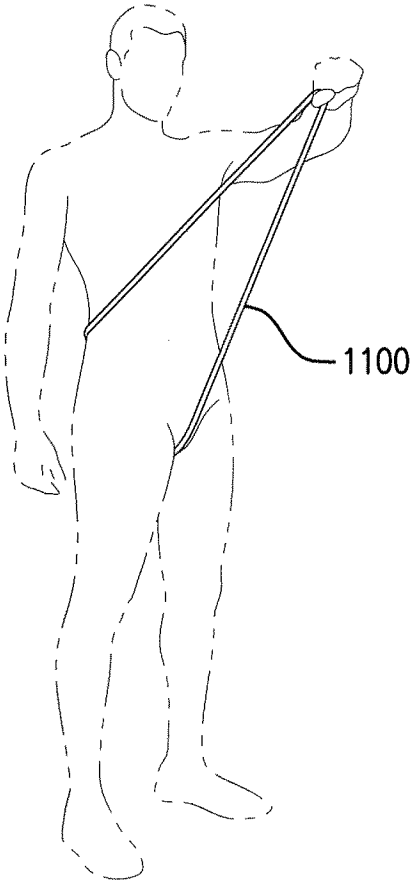
Figure 11E:
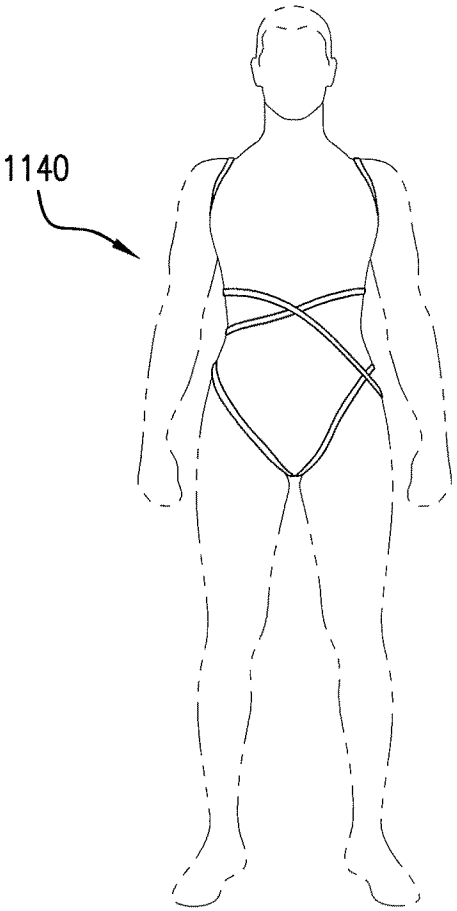
Figure 11D:
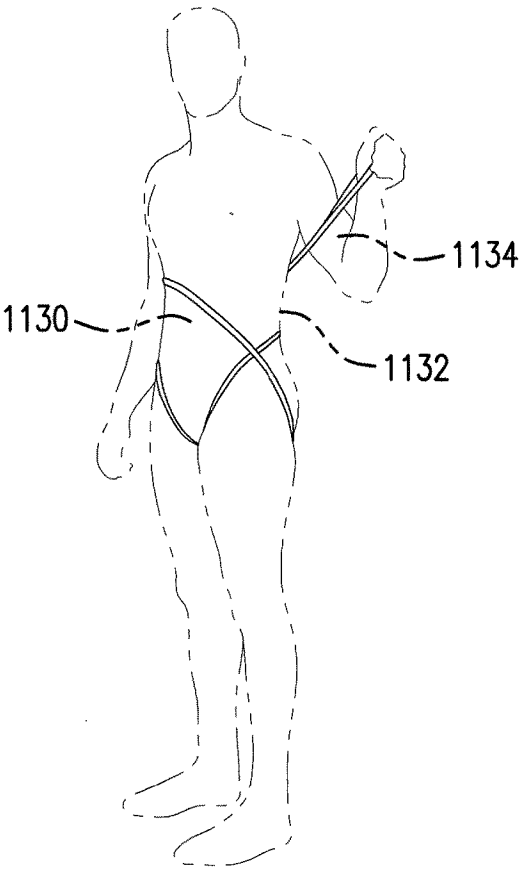

FIG. 9 is an example of a bar for use with elastic bands according to one embodiment of the invention. In various embodiments, one or more elastic bands may be attached to bar 900 at a first attachment point 910 and a second attachment point 920. Attachment points 910 and 920 may comprise any suitable attachment mechanism. For example, attachment points 910 and 920 may each comprise an eye bolt fastened to the bar 900, an eyelet positioned in the bar 900, or any other suitable mechanism.

For example, the attachment points 910 and 920 may each comprise a recess in and along a small length of each end of bar 900. Each recess may be semi-circular, rectangular, concave, or any other appropriate shape. Each recess may comprise a distal inside edge and a proximal inside edge. Further, the attachment points may each comprise a rod spanning across the recess between the distal inside edge and the proximal inside edge placing it near the outer surface of the bar 900, thereby providing a suitable attachment point. In other embodiments, the rod may be a gate with a pivot end and an opening end, similar to carabiner 400, to provide a convenient method of attachment. In still other embodiments, one or more carabiners 400 may be used to attach elastic bands to bar 900. Linear bands are shown in conjunction with the embodiment shown in FIG. 9. In another embodiment, circular elastic bands may be connected to the bar 900. As seen in FIG. 9, multiple bands may be connected to the bar 900. In embodiments in which more than one band has been attached, the bands may comprise at least one circular elastic band and at least one linear elastic band.

Bar 900 may be metal, plastic, PVC, wood, or any other suitable material. In some embodiments, the bar 900 may comprise multiple sections that may be coupled using various mechanisms to assemble and disassemble the bar. This advantageously provides a bar that is easily portable. The coupling mechanisms may comprise threaded ends of the bar sections that may be screwed together, bar sections that slide over each other and are fastened in place using pins, or any other suitable coupling mechanism. In another embodiment, sections of the bar 900 may be assembled as a telescoping device that may telescope from a first smaller length to a second longer length suitable for exercising.

Figure 13A:
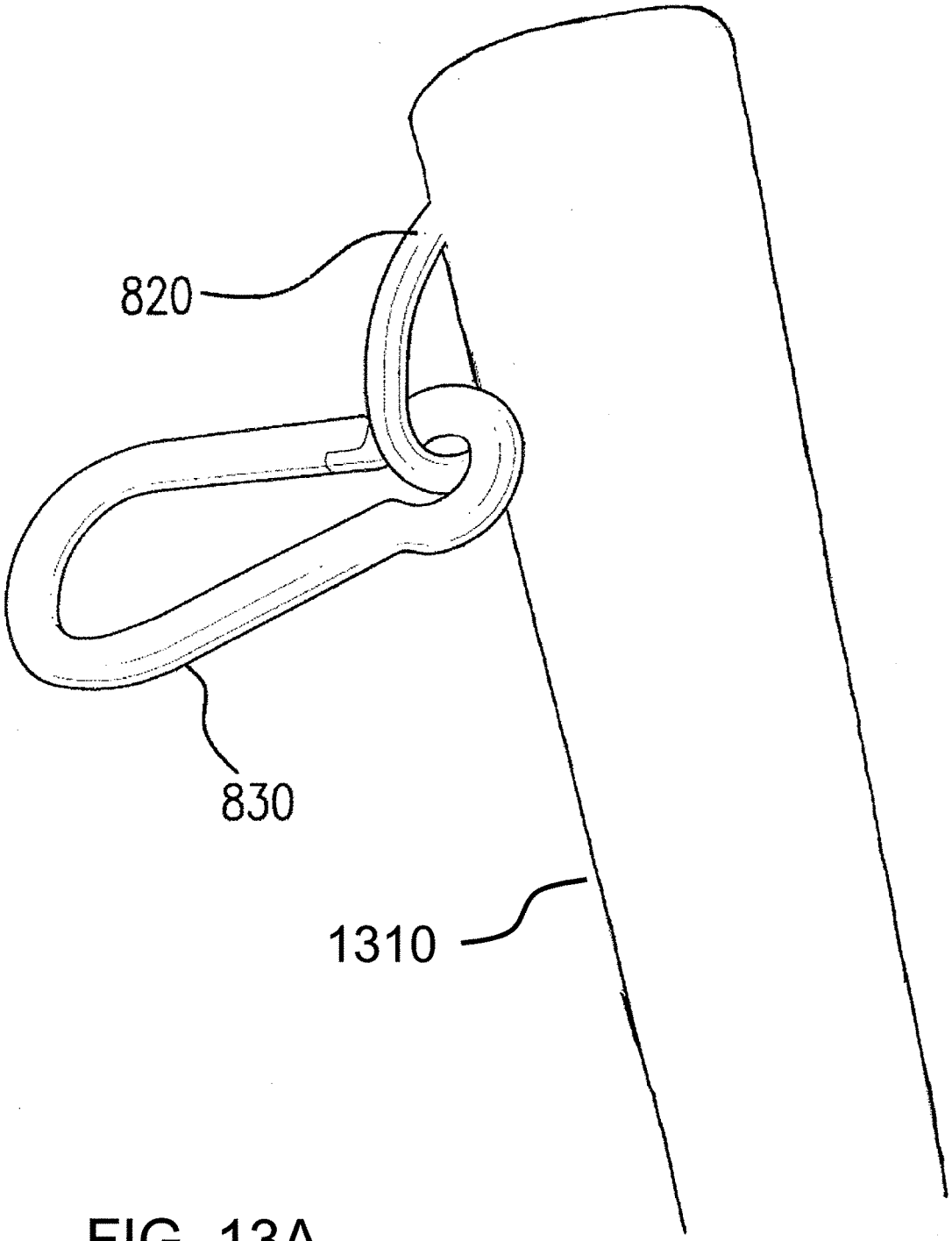
FIG. 13A is an example of a bat for use with elastic bands according to one embodiment of the invention.
Figure 13B:
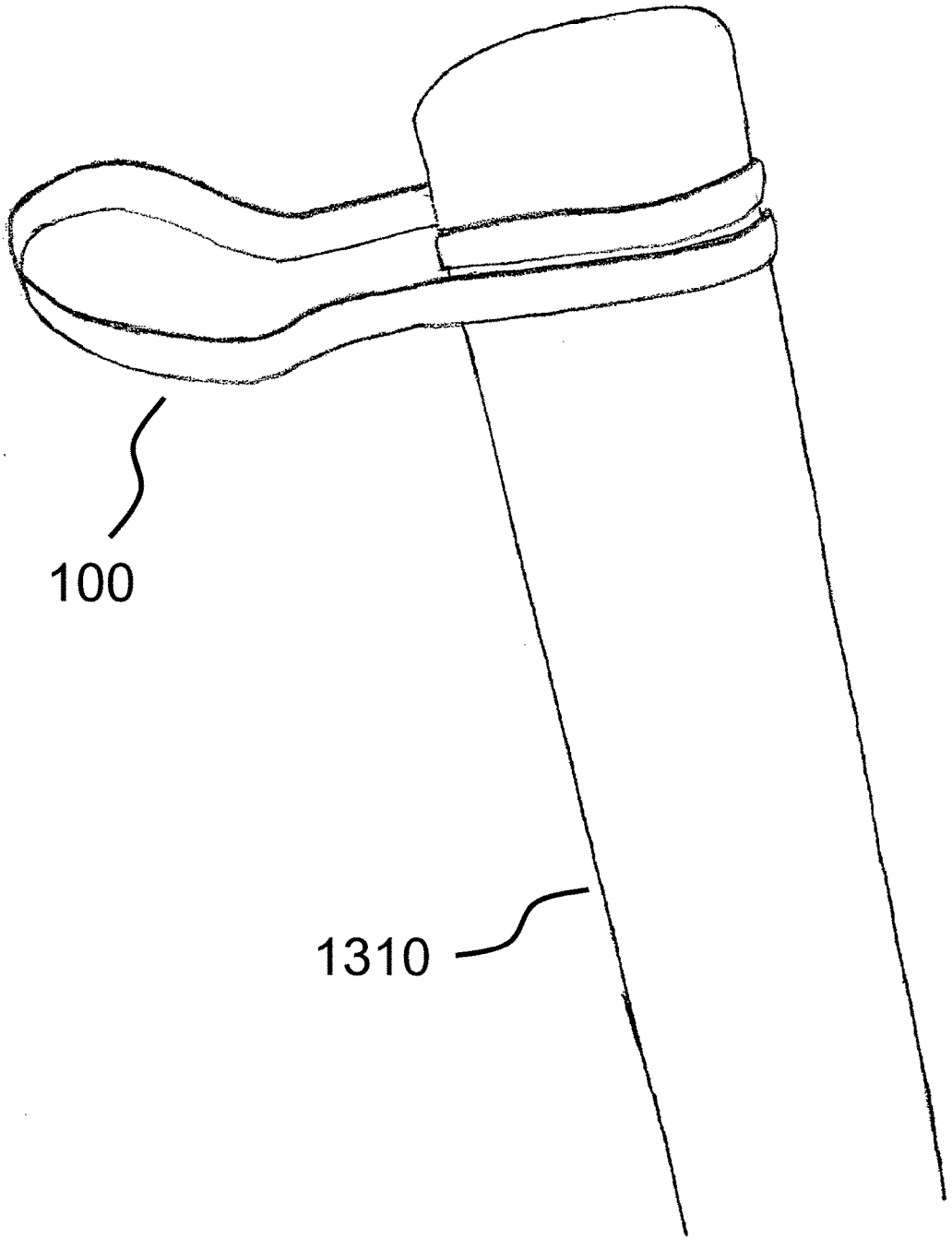
FIG. 13B is an example of a bat for use with elastic bands according to one embodiment of the invention.

In further embodiments, methods of performing swing exercises are provided. In one embodiment, a method of performing a baseball swing is provided. For example, a method may include insert the door strap 700 into a door and attach a band 100 to the door strap 700 as described herein. In one embodiment, the method includes placing the door strap at a level at which a user would normally swing a baseball bat for example, in the user's "strike zone." The method next includes looping the band 100 around a baseball bat 1310 (illustrated in FIG. 13B) and swinging the bat. The band 100 provides resistance and may help in development of the muscles involved with swinging a baseball bat 1310.

Figure 14A:
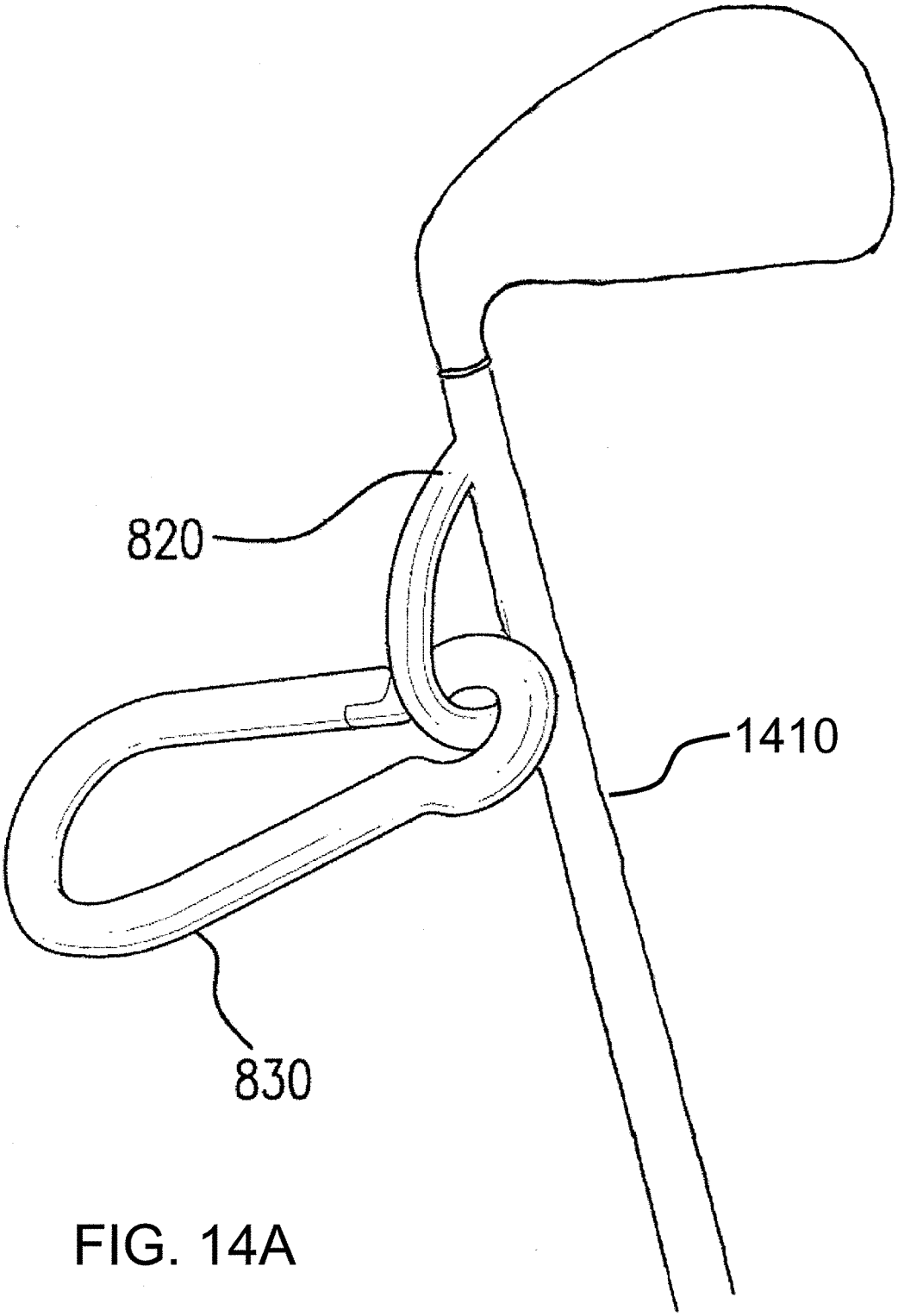
FIG. 14A is an example of a golf club for use with elastic bands according to one embodiment of the invention.
Figure 14B:
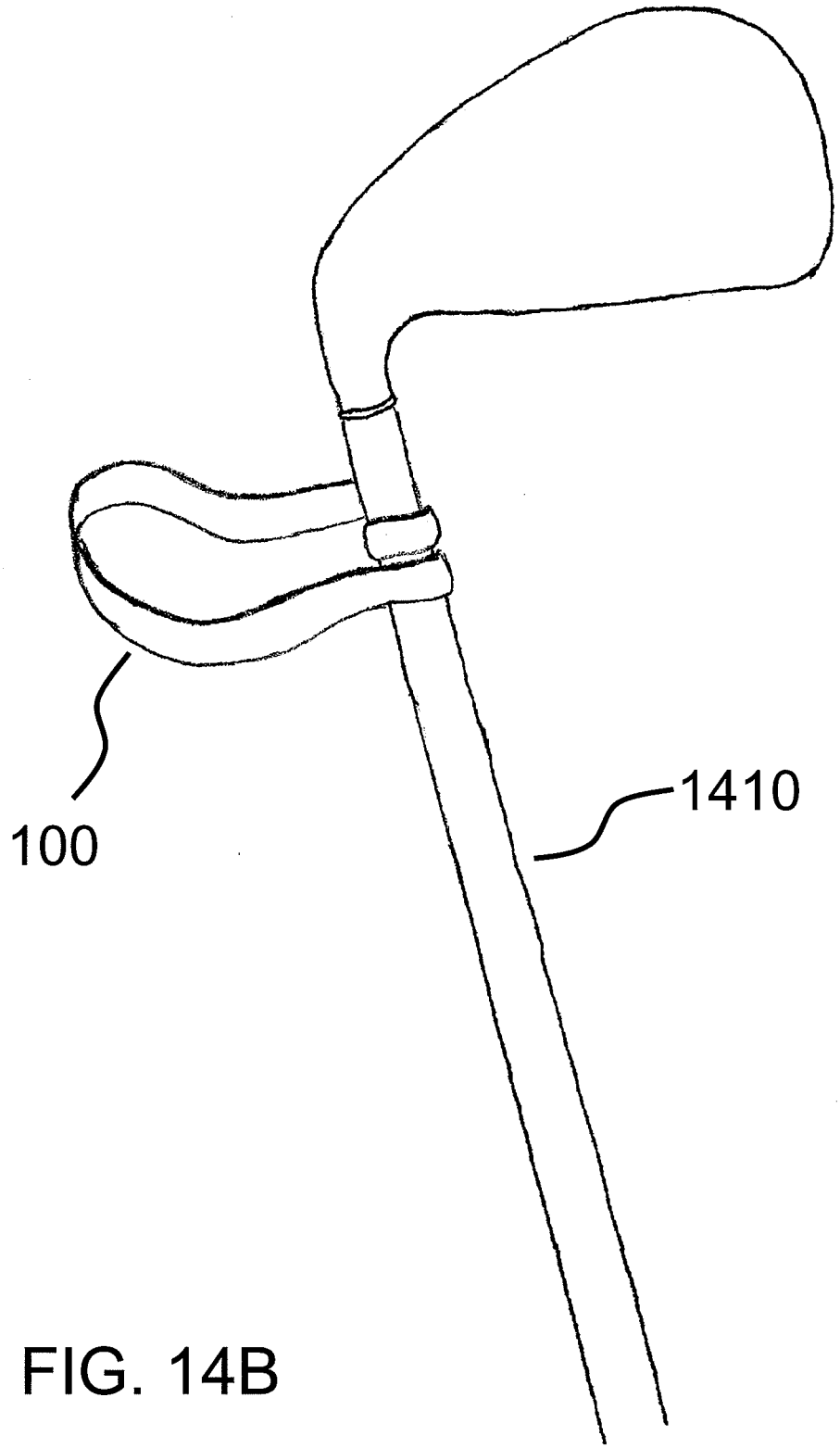
FIG. 14B is an example of a golf club for use with elastic bands according to one embodiment of the invention.

In a still further embodiment, a method of performing a golf swing is provided. For example, a method may include inserting the door strap 700 into a door and attaching a band 100 to the door strap 700 as described herein. In one embodiment, the method includes placing the door strap at a level at which a user would normally swing a golf club, such as near the ground. The method next includes looping the band 100 around the head of a golf club 1410 (illustrated in FIG. 14B) and swinging the golf club. The band 100 provides resistance and may help in development of the muscles involved with swinging a golf club 1410.

Further embodiments include using straps or specialized components, such as a carabiner 830 and an attachment point 820, to attach the bat 1310 (FIG. 13A) or club 1410 (FIG. 14A) to the band 100.

FIGS. 10A through 10E include examples of performing exercises using an elastic band according to one embodiment of the invention. In one embodiment, a user can perform one or more exercises using an elastic band 100. Those exercises can include multi-planar exercises. A multi-planar exercise is one in which involves movements in multiple planes. For example, if an exercise involves both horizontal and vertical resistance, it is multi-planar.

In one embodiment, using a band 100 to perform a standing press is disclosed. As shown, for example, in FIG. 10A, a user may stand with feet approximately shoulder-width apart and place the band 100 under his or her feet 1000. The user may also grasp the top of the band 100 with each hand 1002. Next, the user may push the band upward in order to complete the press 1010.

In one embodiment, using a band 100 to perform a lat pulldown is disclosed. As shown, for example, in FIG. 10C, a user may stand with feet approximately shoulder-width apart and place the band 100 under his or her feet 1020. The user may also grasp the top of the band 100 with each hand 1022. Next, the user may pull his or her arms down horizontally in order to complete the lat pulldown 1022.

In one embodiment, using a band 100 to perform a squat is disclosed. As shown, for example, in FIG. 10D, a user may stand with feet approximately shoulder-width apart and place the band 100 under his or her feet 1030. The user may also grasp the top of the band 100 with each hand 1032. The user may position his or her hands in various ways in order to work various muscle groups. For example, the user may hold his or her hands away from the body 1032. Also, he or she may hold his or her hands above the head 1010. While holding the hands and arms steady, the user may perform a traditional squat exercise by bending at the knees 1034. The result is a multi-planar exercise that engages multiple muscle groups—upper body, lower body, and core—in a single movement.

In a further embodiment, using a band 100 to perform a core twist is disclosed. As shown, for example, in FIG. 10E, a user may stand with feet approximately shoulder-width apart and place the band 100 under his or her feet 1040. The user may also grasp the top of the band 100 with each hand 1042. The user may position his or her hands in various ways in order to work various muscle groups. For example, the user may hold his or her hands away from the body 1042. Also, he or she may hold his or her hands above the head 1010. While holding the hand and arms steady, the user may twist the body 1044 in order to perform a core twist to acquire resistance in a horizontal plane. The result is a multi-planar exercise that engages multiple muscle groups—upper body, lower body, and core—in a single movement.

FIGS. 11A through 11E are an example of performing an exercise using two elastic bands according to one embodiment of the invention. In one embodiment of the invention, an exercise using two elastic bands is disclosed. There is a need for exercises and techniques to improve posture, stabilize the core, and potentially relieve and/or prevent lower back pain. An example of such an exercise is the aligner. In one embodiment, the aligner is performed using two bands.

In one embodiment, the user inserts his or her right leg into a first band 1100 up to the user's groin. Next, the user may wrap the first band 1100 around his or her stomach 1110 and around the back 1112, and inserts the right arm 1114. The user may stabilize the band around his or her right shoulder.

In one embodiment, the user wraps a second band 1120 around the user's left leg up to the user's groin. Next, the user may wrap the second band 1120 around his or her stomach 1130 and around the back 1132, and inserts the left arm 1134. Next, a user may contract his or her abdominals and maintain a straight posture 1140. The first and second band will provide resistance that draws the user's shoulders back and opens the user's chest while stacking the spine to naturally straighten the user's posture.

It will be apparent to one of skill in the art that variations on the aligner may be practiced in accordance with embodiments of the present invention. For example, a user could start with the left side instead of the right side. Furthermore, a grip or similar hand strap device may be used to prevent friction between the bands and the shoulder region while engaged in the aligner.

Figure 12A:
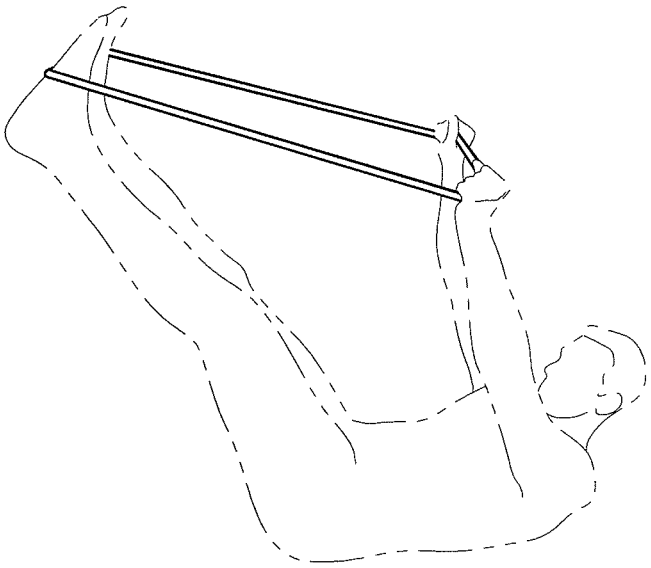
FIGS. 12A-B are an example of performing an exercise using an elastic band according to one embodiment of the invention.
Figure 12B:
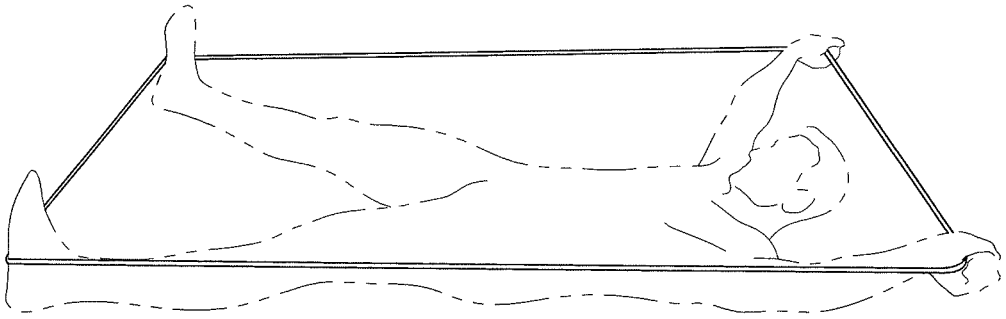

FIGS. 12A and 12B are an example of performing an exercise using an elastic band according to one embodiment of the invention. In one embodiment, a user can perform one or more exercises using an elastic band 100. Those exercises can include multi-planar exercises. A multi-planar exercise is one which involves movements in multiple planes. For example, if an exercise involves both horizontal and vertical resistance, it is multi-planar.

For example, in the embodiment illustrated in FIG. 12A and FIG. 12B, the starfish exercise, a user lays on his back on a surface with his legs straight and raised at angle between approximately 35 and 55 degrees in relation to the surface. The user places a band 100 around the bottom of his feet as shown and grips the band with both hands with straight arms raised approximately vertically in the air. The user then spreads and lowers his legs to a position closer to the surface and concurrently moves his arms to a position spread above his head and closer to the surface, thereby causing the band 100 to exert a resistance in multiple planes on the user. The result is a multi-planar exercise that engages multiple muscle groups—upper body, lower body, and core—in a single movement.

In other embodiments, one or more bands 100, handles 200, carabiners 400, 500, grips 600, gripping devices 800, and/or bars 900 may comprise an easily portable fully comprehensive resistance exercise kit. In other embodiments, the kit may further comprise an instructional training video and/or instructional training manual. The instructional training video and/or instructional training manual may comprise instructions for replicating traditional resistance exercises. In other embodiments, the instructional training manual and/or instructional training video may comprise instructions for performing stretches and exercises including multi-planar and functional training exercises. Kits according to these and other embodiments of the invention are advantageously portable, inexpensive, and provide the ability to learn and perform a fully comprehensive resistance training regimen, including single-plane and multi-planar exercises.

It is apparent that there has been provided, in accordance with the present invention, apparatuses and methods for exercise using circular bands. While the present invention has been particularly shown and described in conjunction with examples and preferred embodiments thereof, it will be appreciated that variations in and modifications to the present invention may be effected by persons of ordinary skill in the art without departing from the spirit or scope of the invention. It is to be understood that the principles described herein apply in a similar manner, where applicable, to all such examples and embodiments which the following claims are intended to cover.

That which is claimed is:

1. A method of exercising the human body, comprising:

(a) providing a solid continuous circular elastic band having a flat inner surface and a flat outer surface, wherein the band comprises multiple layers of an elastic material;

(b) simultaneously exerting (i) a first force against the inner surface of the band at a first location on the band, and (ii) a second force against the inner surface of the band at a second location on the band; where the first force and the second force are not exerted in the same direction, thereby stretching the band and causing the band to resist the simultaneous exertion of the first force and the second force, wherein simultaneously exerting the first force and the second force comprises performing a core twist exercise.

2. The method of claim 1, wherein the first force is exerted using an attachment, where the attachment is a handle, a carabiner, or a gripping device.

3. The method of claim 2, wherein the attachment is a handle, and the handle is attached to the band via a carabiner.

4. The method of claim 2, wherein the attachment is a gripping device.

5. The method of claim 2, wherein the attachment is attached to the elastic band by looping the elastic band around the attachment.

6. A method of exercising the human body, comprising:

(a) providing a solid continuous circular elastic band having a flat inner surface and a flat outer surface, wherein the band comprises multiple layers of an elastic material;

(b) simultaneously exerting (i) a first force against the inner surface of the band at a first location on the band, and (ii) a second force against the inner surface of the band at a second location on the band; where the first force and the second force are not exerted in the same direction, thereby stretching the band and causing the band to resist the simultaneous exertion of the first force and the second force, wherein simultaneously exerting the first force and the second force comprises performing a starfish exercise.

7. The method of claim 6, wherein simultaneously exerting the first force and the second force comprises performing a squat exercise.

8. The method of claim 6, wherein the first force is exerted using an attachment, where the attachment is a handle, a carabiner, or a gripping device.

9. The method of claim 8, wherein the attachment is a handle, and the handle is attached to the band via a carabiner.

10. The method of claim 8, wherein the attachment is a gripping device.

11. The method of claim 8, wherein the attachment is attached to the elastic band by looping the elastic band around the attachment.

* * * * *